United States Patent [19]

Hooper et al.

[11] Patent Number: 4,719,765

[45] Date of Patent: Jan. 19, 1988

[54] ICE STORAGE RECEPTACLE LIGHT FOR ICE MAKER

[75] Inventors: Charles R. Hooper, Knight Township, Vanderburgh County, Ind.; Lawrence W. Michal, Arden Hills, Minn.

[73] Assignee: Whirlpool Corporation, Benton Harbor, Mich.

[21] Appl. No.: 909,172

[22] Filed: Sep. 19, 1986

[51] Int. Cl.[4] ..... F25D 27/00

[52] U.S. Cl. ..... 62/264; 62/348; 362/290

[58] Field of Search ..... 62/264, 348; 362/290, 362/326, 330

[56] References Cited

U.S. PATENT DOCUMENTS

| | | | |
|---|---|---|---|
| 2,398,799 | 4/1946 | Miller | 362/290 X |
| 2,695,502 | 11/1954 | Muffly | 62/4 |
| 2,891,387 | 6/1959 | Cocanour | 62/233 |
| 2,953,909 | 9/1960 | Sharpe | 62/264 |
| 2,995,649 | 8/1961 | Cyrus | 62/264 X |
| 3,378,980 | 4/1968 | Blitzer, Jr. | 362/290 X |
| 3,446,955 | 5/1969 | Bailey et al. | 362/290 |
| 3,525,232 | 8/1970 | Toma | 62/137 |
| 3,878,693 | 4/1975 | Prada | 62/131 |
| 3,885,150 | 5/1975 | Ott | 362/290 X |
| 3,946,573 | 3/1976 | Nichols et al. | 62/125 |
| 4,009,595 | 3/1977 | Barnard et al. | 62/300 |
| 4,063,079 | 12/1977 | Feder | 362/290 |

*Primary Examiner*—William E. Tapolcai

*Attorney, Agent, or Firm*—Wood, Dalton, Phillips, Mason & Rowe

[57] ABSTRACT

An ice body maker having a storage bin into which ice bodies are delivered from ice slab cutting structure. The ice bodies in the storage bin are illuminated from a lamp which utilizes the grid wires of the cutting structure as a diffusion structure for minimizing glare, facilitating observation of the ice bodies and removal thereof by the user. The lamp is located so as to direct the light therefrom primarily away from the access opening for further improved illumination of the ice bodies. The lamp is preselected to provide sufficient illumination to illuminate the ice bodies through an ice slab carried on the grid structure as during a slab cutting operation and utilizes the ice slab itself as a further light diffusion element. Still further diffusion of the light for improved uniformity on the ice bodies is effected by the reticulation of the ice slab effected by the grid wires in cutting through the slab during the slab cutting operation.

14 Claims, 3 Drawing Figures

ICE STORAGE RECEPTACLE LIGHT FOR ICE MAKER

BACKGROUND OF THE INVENTION

1. Field of the Invention

This invention relates to ice makers and in particular to ice makers having a storage bin in which formed ice bodies are collected for removal by a user of the apparatus, as desired.

2. Description of the Background Art

In U.S. Pat. No. 4,009,595 of Walter C. Barnard, et al., which patent is owned by the assignee hereof, a slab-type ice maker is shown to include means for forming an ice slab on a refrigerated evaporator plate by circulation of water thereover. Upon completion of the formation of the desired thickness ice slab, the slab is released from the plate by suitably heating the plate and permitting the slab to slide downwardly therefrom onto a cutting grid.

The cutting grid comprises a grid of heating wires which, when energized, melt the slab along the lines of the wires to sever the ice slab into a plurality of ice cubes, or bodies, which fall through the grid into a subjacent collecting bin from which they may be removed as desired by the user of the apparatus.

This apparatus is conventionally mounted within an outer cabinet defining a front opening which is selectively closed by a door. When the user wishes to withdraw a quantity of ice bodies from the storage bin, he opens the door and may utilize a conventional scoop to remove the desired quantity of ice bodies. It is desirable at this time to illuminate the storage bin to facilitate the dispensing operation and permit the user to observe the quantity and location of the ice bodies in the collecting bin.

It is conventional to illuminate the collecting bin by providing a lamp superjacent the bin, such as disclosed in U.S. Pat. No. 3,878,693 of Luis E. Prada. The arrangement in the Prada patent presents several problems in that light from the lamp may reflect off the ice bodies and cause a glare when the collection of ice bodies is viewed through the front opening of the cabinet. In addition, the exposed location of the lamp subjects the lamp to possible damage by the scoop utilized in withdrawing ice bodies from the collecting bin.

SUMMARY OF THE INVENTION

The present invention comprehends an improve refrigeration apparatus wherein glare from light reflecting off the ice bodies in a storage bin, when observed by a user intending to withdraw ice bodies from the storage bin, is effectively minimized.

More specifically, the invention comprehends an improved refrigeration apparatus wherein light diffusing means are interposed between the light source and the ice body collecting bin.

The invention comprehends the utilization of a wire grid to define such a light-diffusing means. In the illustrated embodiment, the wire grid further defines means for cutting an ice slab delivered thereonto into a plurality of ice bodies for transfer downwardly into the collecting bin upon the completion of a slab cutting operation.

The invention comprehends that the lamp utilized for lighting the ice bodies in the collecting bin be disposed suitably so as to direct the light therefrom primarily away from the cabinet opening so as to further reduce reflected glare from the ice bodies outwardly through the opening.

The invention comprehends that the lamp be located so as to provide further diffusion of the light therefrom by passage of the light through the ice slab on the wire grid when the ice slab is disposed thereon to be cut by the wires into the desired ice bodies.

The invention comprehends that the wire grid be energized from a low voltage alternating current power supply, and in the illustrated embodiment, the lamp is energized from the same power supply so as to constitute a low voltage lamp providing improved safety in the operation of the refrigeration apparatus.

By locating the lamp above the slab-cutting means, the light is effectively protected from engagement by the ice body removing scoop, as during removal of ice bodies from the collecting bin by the user.

The improved collected ice body illumination means of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
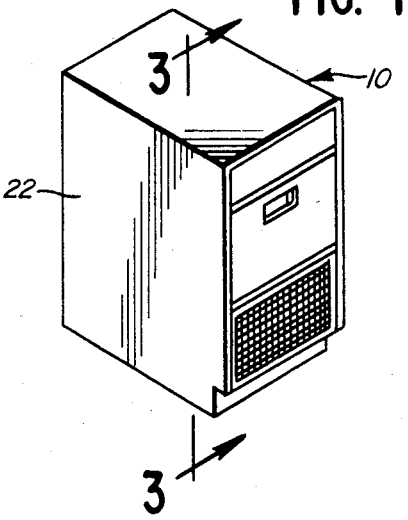
FIG. 1 is a perspective view of a refrigeration apparatus embodying the invention.

In the illustrative embodiment of the invention as disclosed in the drawing, an ice body maker generally designated 10 is shown to include a refrigerated tray 11, which may comprise an evaporator plate refrigerated by conventional referigeration means (not shown).

An ice slab 12 is built up on the tray 11 by circulation of water over the tray from a distribution header 13. The water is collected in a sump 14 and recirculated through the header 13 by a recirculation pump 15. An overflow 16 to drain from the sump maintains the level of the water in the sump.

Figure 3:
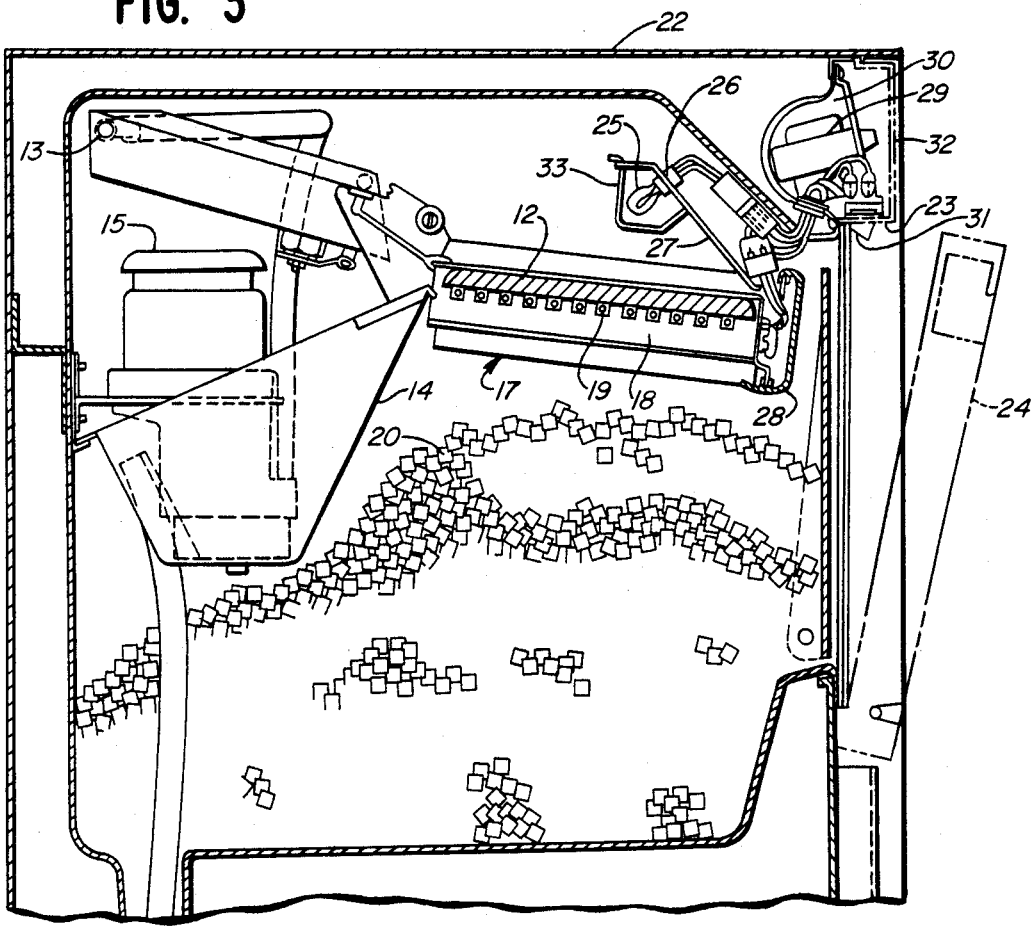
FIG. 3 is a vertical section taken substantially along the line 3—3 of FIG. 1, illustrating the arrangement of the illuminating means in association with the ice body forming means within the cabinet of the refrigeration apparatus.

When the ice slab reaches a desired thickness, as illustrated in FIG. 3, the apparatus automatically discontinues further ice formation on tray 11 and effects a heating of the tray so as to permit the ice slab to slide downwardly on the inclined tray onto an adjacent cutting grid 17.

The cutting grid includes a frame 18 supporting crossed electrical heating wires 19 in a grid configuration.

Figure 2:
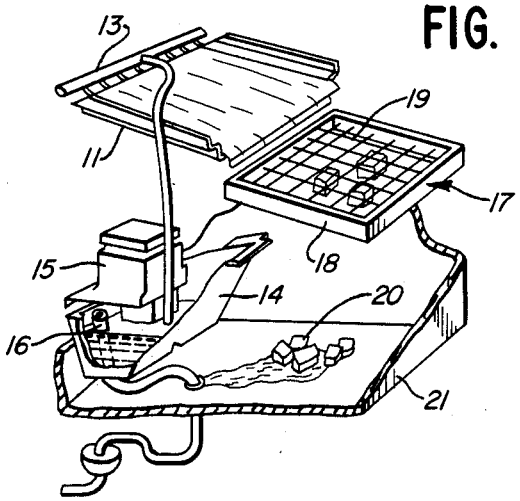
FIG. 2 is a schematic perspective view illustrating the arrangement of the ice body forming elements thereof.

Energization of the heating wires causes a melting of the ice slab delivered onto the grid from the tray 11 into a plurality of ice cubes, or ice bodies, 20, as seen in FIG. 2.

The ice bodies are collected in a subjacent storage, or collecting, bin 21 within the outer cabinet 22. Access to the collecting bin is provided through a front opening 23, which is selectively closed by a closure door 24 hingedly mounted to the cabinet, as seen in FIG. 3.

The invention comprehends an improved means for illuminating the ice bodies collected in the storage bin 21 so as to permit facilitated and improved observation of the level and location of the ice bodies in the storage bin by the user when viewing the same through the opening 23 upon opening the door 24, thereby facilitating the withdrawal of the desired quantity of ice bodies from the ice maker.

More specifically, as best seen in FIG. 3, the illuminating means includes a lamp 25 removably carried in a socket 26 mounted to a support plate 27, in turn mounted to the cutting grid 17 at a front grid panel portion 28 thereof.

A voltage reducing transformer 29 is mounted within the upper front portion 30 of cabinet 22 for energizing the heating wires 19. As shown in FIG. 3, lamp 25 is connected to the transformer 29 through a door-activated switch 31 mounted to the cabinet at the top of front opening 23. Thus, lamp 25 comprises a low voltage lamp providing further improved safety in the use thereof. Switch 31 is covered by a removable escutcheon assembly 32, as shown in FIG. 3.

As further illustrated in FIG. 3, light from lamp 25 is directed primarily rearwardly, or away from opening 23, so as to minimize reflection of the light into the eyes of a viewer looking inwardly through opening 23 as during removal of ice bodies from the collecting bin.

As discussed above, the invention comprehends that the light be passed through grid 17 for diffusion of the light by the reticulated grid, thereby further improving the uniformity of the light illuminating the ice bodies in the collecting bin.

The invention comprehends that the light be of sufficient power to illuminate the ice bodies notwithstanding the provision of the ice slab 12 on the grid as during an ice cutting operation should the user withdraw ice bodies at that time. The arrangement is preselected so that the light is further diffused by passage through the ice slab 12 on the grid, thus further providing improved, uniform nonglare illumination of the ice bodies in the collecting bin. The reticulation of the slab caused by the melting thereof along the network of lines defined by the heater wires provides still further diffusion of the light at this time.

The location of the lamp superjacent the grid 17 provides for facilitated servicing thereof when desired, while at the same time, effectively avoids damage to the lamp as by the scoop normally employed by a user in removing ice bodies from the subjacent collecting bin. Thus, the grid serves not only as a means for diffusing the light from lamp 25, but also serves as means for protecting the lamp against inadvertent damage as by engagement by a scoop, or the like, during withdrawal of the ice bodies from the ice maker.

In the illustrated embodiment, a transparent shield 33 may be mounted to the support plate 27 for protecting the lamp against water spray and the like, thereby providing long, troublefree life of the lamp in the desired ice body illumination operation. The shield further prevents falling of the lamp onto the grid and possibly into the collecting bin.

In the illustrated embodiment, transformer 29 provides a low voltage of approximately 8.7 volts from the conventional 120-volt alternating current power supply to which the ice maker would normally be connected for operation of the pump 15 and refrigeration apparatus thereof. The lamp is illuminated only when the door 24 is in the open position, as illustrated in FIG. 3, and thus, the lamp may have an extremely long, useful life effectively minimizing any need for maintenance of the illuminating means for long periods of time.

The improved illumination means of the present invention is extremely simple and economical of construction, while yet providing for improved illumination of the ice bodies in a collecting bin and, thus, for improved observation and removal of the ice bodies by the user in the normal dispensing operation.

The foregoing disclosure of specific embodiments is illustrative of the broad inventive concepts comprehended by the invention.

We claim:

1. In a refrigeration apparatus having a cabinet defining an access opening, a bin in said cabinet for storage of ice bodies therein, ice body forming means in said cabinet, and closure means for providing selective access to said bin through said opening for removal of a desired quantity of ice bodies therefrom, improved illuminating means for illuminating the ice bodies in the bin for observation thereof through said opening, said illuminating means comprising:

a lamp; and means for mounting the lamp in said cabinet spaced above said bin, a portion of said ice body forming means disposed between said lamp and the ice bodies in said bin comprising means for diffusing light shining from said lamp onto the ice bodies in said bin.

2. The refrigeration apparatus of claim 1 wherein said ice body forming means portion comprises a substantially planar wire grid.

3. The refrigeration apparatus of claim 1 wherein said ice body forming means portion comprises a substantially planar electric heater wire grid.

4. The refrigeration apparatus of claim 3 wherein said apparatus includes a voltage reducing transformer means for energizing said lamp and said electric wire grid at a preselected low voltage.

5. The refrigeration apparatus of claim 1 wherein the lamp mounting means comprises means for mounting the lamp adjacent said cabinet opening for directing light therefrom into the bin primarily in a direction away from said opening.

6. In a refrigeration apparatus having a cabinet defining an access opening, a bin in said cabinet for storage of ice bodies therein, and closure means for providing selective access to said bin through said opening for removal of a desired quantity of ice bodies therefrom, improved illuminating means for illuminating the ice bodies in the bin for observation thereof through said opening, said illuminating means comprising:

ice forming means for forming an ice slab;

a lamp;

means for mounting the lamp in said cabinet spaced above said bin; and slab cutting means for dividing the ice slab received from said ice forming means into a plurality of ice bodies, said slab cutting means being spaced below said lamp and above the ice bodies in said bin and defining means for diffusing light shining from said lamp onto the ice bodies in said bin.

7. The refrigeration apparatus of claim 6 wherein said slab dividing means comprises an electric heater wire grid and said apparatus includes a voltage reducing transformer means for energizing said lamp and said electric wire grid at a preselected low voltage.

8. The refrigeration apparatus of claim 6 wherein the lamp mounting means comprises means for mounting the lamp adjacent said cabinet opening for directing light therefrom into the bin primarily in a direction away from said opening.

9. In a refrigeration apparatus having a cabinet defining an access opening, a bin in said cabinet for storage of ice bodies therein, and closure means for providing selective access to said bin through said opening for removal of a desired quantity of ice bodies therefrom, improved illuminating means for illuminating the ice bodies in the bin for observation thereof through said opening, said illuminating means comprising:

ice forming means for forming an ice slab;

a lamp;

means for mounting the lamp in said cabinet spaced above said bin;

grid means for receiving the ice slab from said ice forming means, said grid means being spaced below said lamp and above said bin, said grid means defining means for diffusing light shining from said lamp onto the ice bodies in said bin, said grid means comprising heating wire means; and means for energizing said heating wire means for cutting an ice slab received thereon into a plurality of ice bodies and permit the ice bodies to fall from the grid into said bin, said lamp providing sufficient light for diffusively illuminating the ice bodies in said bin through said grid means and an ice slab on said grid means.

10. In a refrigeration apparatus having a cabinet defining an access opening, a bin in said cabinet for storage of ice bodies therein, and closure means for providing selective access to said bin through said opening for removal of a desired quantity of ice bodies therefrom, improved illuminating means for illuminating the ice bodies in the bin for observation thereof through said opening, said illuminating means comprising:

means for forming an ice slab;

a lamp means for mounting the lamp in said cabinet spaced above said bin; and support means for supporting said slab of ice spaced below said lamp and above said bin for causing the slab to diffuse light shining downwardly from said lamp and past said support means onto the ice bodies in said bin.

11. The refrigeration apparatus of claim 10 wherein the lamp mounting means comprises means for mounting the lamp adjacent said cabinet opening for directing light therefrom into the bin primarily in a direction away from said opening.

12. In a refrigeration apparatus having a cabinet defining an access opening, a bin in said cabinet for storage of ice bodies therein, and closure means for providing selective access to said bin through said opening for removal of a desired quantity of ice bodies therefrom, improved illuminating means for illuminating the ice bodies in the bin for observation thereof through said opening, said illuminating means comprising:

means for forming an ice slab;

a lamp means for mounting the lamp in said cabinet spaced above said bin; and support means for supporting said slab of ice spaced below said lamp and above said bin for diffusing light shining from said lamp onto the ice bodies in said bin, said support means comprising means defining a plurality of through openings passing the light from the ice slab downwardly therethrough into said bin.

13. The refrigeration apparatus of claim 12 wherein said through openings further comprise means for diffusing the light in passing the light from the ice slab downwardly therethrough into said bin.

14. In a refrigeration apparatus having a cabinet defining an access opening, a bin in said cabinet for storage of ice bodies therein, and closure means for providing selective access to said bin through said opening for removal of a desired quantity of ice bodies therefrom, improved illuminating means for illuminating the ice bodies in the bin for observation thereof through said opening, said illuminating means comprising:

means for forming an ice slab;

a lamp;

means for mounting the lamp in said cabinet spaced above said bin; and support means for supporting said slab of ice spaced below said lamp and above said bin for diffusing light shining from said lamp onto the ice bodies in said bin, said support means comprising means for introducing temporarily into an ice slab received thereon a network of grooves in the slab causing further diffusion of light passing through the slab from the lamp to the bin.

* * * * *